US007831331B1

(12) United States Patent
Samilo

(10) Patent No.: US 7,831,331 B1
(45) Date of Patent: Nov. 9, 2010

(54) APPARATUS AND METHOD FOR DETECTING KNIFE POSITION ON A TUFTING MACHINE

(75) Inventor: John Samilo, Ringgold, GA (US)

(73) Assignee: CYP Technologies, LLC, Chattanooga, TN (US)

( * ) Notice: Subject to any disclaimer, the term of this patent is extended or adjusted under 35 U.S.C. 154(b) by 826 days.

(21) Appl. No.: 11/810,216

(22) Filed: Jun. 5, 2007

(51) Int. Cl.
*D05C 15/18* (2006.01)

(52) U.S. Cl. ..... 700/138; 112/80.23; 112/80.3

(58) Field of Classification Search ..... 700/131, 700/132, 138; 112/80.01, 80.23, 80.3, 80.7, 112/80.71
See application file for complete search history.

(56) References Cited

U.S. PATENT DOCUMENTS

| | | | | |
|---|---|---|---|---|
| 3,364,888 | A | 1/1968 | Sibley, Jr. et al. | |
| 3,529,560 | A | 9/1970 | Jackson | |
| 3,722,434 | A | 3/1973 | Strother et al. | |
| 4,109,594 | A | 8/1978 | Spanel et al. | |
| 4,519,332 | A | 5/1985 | Fukuda | |
| 4,867,080 | A | 9/1989 | Taylor et al. | |
| 5,005,503 | A | 4/1991 | Trahan et al. | |
| 5,503,092 | A | 4/1996 | Aubourg et al. | |
| 5,562,056 | A | 10/1996 | Christman, Jr. | |
| 5,588,383 | A | 12/1996 | Davis et al. | |
| 5,979,344 | A | 11/1999 | Christman, Jr. | |
| 6,283,052 | B1 | 9/2001 | Pratt | |
| 6,293,211 | B1 * | 9/2001 | Samilo | 112/80.16 |
| 6,807,917 | B1 * | 10/2004 | Christman et al. | 112/80.23 |
| 6,834,601 | B2 * | 12/2004 | Card et al. | 112/80.23 |
| 6,834,602 | B1 | 12/2004 | Hall | |
| 7,096,806 | B2 | 8/2006 | Card et al. | |
| 7,347,151 | B1 * | 3/2008 | Johnston et al. | 700/136 |
| 7,717,051 | B1 * | 5/2010 | Hall et al. | 112/475.05 |
| 2002/0043202 | A1 | 4/2002 | Freeman et al. | |
| 2004/0022994 | A1 | 2/2004 | Higgins et al. | |

FOREIGN PATENT DOCUMENTS

| | | |
|---|---|---|
| EP | 0058510 | 8/1982 |

* cited by examiner

*Primary Examiner*—Danny Worrell
(74) *Attorney, Agent, or Firm*—Chambliss, Bahner & Stophel, P.C.

(57) ABSTRACT

An apparatus and method for detecting the position of a knife on a tufting machine. The apparatus includes a grounded needle, an electrically-insulated knife adapted to send a knife signal, a solenoid adapted to move the knife, and a programmable logic controller adapted to send a pattern signal to the solenoid, receive the knife signal from the knife, compare the knife signal to the pattern signal, and determine if the knife is in the position prescribed by the pattern signal. The method includes providing such an apparatus, inputting the pattern signal into the programmable logic controller, sending the pattern signal from the programmable logic controller to the solenoid, sending a knife signal from the electrically-insulated knife to the programmable logic controller, comparing the knife signal to the pattern signal, determining if the electrically-insulated knife is in the position prescribed by the pattern signal.

22 Claims, 4 Drawing Sheets

APPARATUS AND METHOD FOR DETECTING KNIFE POSITION ON A TUFTING MACHINE

FIELD OF THE INVENTION

The present invention relates generally to tufting machines, and particularly to tufting machines adapted to determine the position of a knife on the tufting machine.

BACKGROUND AND DESCRIPTION OF THE PRIOR ART

It is known to provide a tufting machine with a system for detecting jammed or broken yarn. See, e.g., U.S. Pat. No. 5,588,383 of Davis et al; U.S. Pat. No. 3,364,888 of Sibley, Jr. et al.; U.S. Pat. No. 3,529,560 of Jackson. However, such conventional tufting machines are not adapted to detect the actual position of a knife, compare the actual position of the knife to the desired position of the knife, and determine when the knife is not in the desired position. It is also known to provide a tufting machine with a system for detecting the position of a needle. See, e.g., U.S. Pat. No. 5,979,344 of Christman, Jr.; U.S. Pat. No. 5,503,092 of Aubourg et al. However, such conventional tufting machines are not adapted to detect the actual position of a knife, compare the actual position of the knife to the desired position of the knife, and determine when the knife is not in the desired position.

It would be desirable, therefore, if an apparatus could be provided that would detect the position of a knife on a tufting machine, compare the actual position of the knife to the desired position of the knife, and determine when the knife is not in the desired position. It would also be desirable if a method could be provided for detecting the position of a knife on a tufting machine, comparing the actual position of the knife to the desired position of the knife, and determining when the knife is not in the desired position. It would be further desirable if an apparatus and method could be provided that would reduce the number of manufacturing defects in and the amount of repair required for a tufted floor covering.

ADVANTAGES OF THE PREFERRED EMBODIMENTS OF THE INVENTION

Accordingly, it is an advantage of the preferred embodiments of the invention described and claimed herein to provide an apparatus that detects the position of a knife on a tufting machine, compares the actual position of the knife to the desired position of the knife, and determines when the knife is not in the desired position. It is also an advantage of the preferred embodiments of the invention described and claimed herein to provide a method for detecting the position of a knife on a tufting machine, comparing the actual position of the knife to the desired position of the knife, and determining when the knife is not in the desired position. It is a further advantage of the preferred embodiments of the invention described and claimed herein to provide an apparatus and method that reduces the number of manufacturing defects in and the amount of repair required for a tufted floor covering.

Additional advantages of the invention will become apparent from an examination of the drawings and the ensuing description.

Explanation of Technical Terms

As used herein, the term "alarm" refers to any indication that the actual position of a knife is not the same as the desired position of the knife, including but not limited to visible indications, audible indications, tactile indications, combinations thereof and the like.

As used herein, the term "electrically-insulated knife" refers to a knife, blade or other suitable cutting device, mechanism, assembly or combination thereof that is electrically insulated or electrically isolated from the knife shaft of the tufting machine.

As used herein, the term "knife signal" refers to any transmitted electrical impulse, electric current, electromagnetic wave or any combination thereof that represents the actual position of a knife. The term "knife signal" also contemplates the absence of a signal.

As used herein, the term "pattern signal" refers to any transmitted electrical impulse, electric current, electromagnetic wave or any combination thereof. The term "pattern signal" also contemplates the absence of a signal.

As used herein, the term "programmable logic controller" refers to any device, mechanism, assembly or combination thereof that is adapted to receive, interpret and/or execute instructions.

As used herein, the term "solenoid" refers to any device, mechanism, assembly or combination thereof that is adapted to move the electrically-insulated knife in response to a pattern signal as that term is defined above.

As used herein, the term "switch" refers to any device, mechanism, assembly or combination thereof adapted to send an instruction to the programmable logic controller as that term is defined above.

SUMMARY OF THE INVENTION

The invention includes an apparatus for detecting the position of a knife on a tufting machine. The apparatus includes a grounded needle adapted to be moved between a penetrating position and a non-penetrating position. The apparatus also includes an electrically-insulated knife that is adapted to be moved between a cutting position and a non-cutting position. The knife is also adapted to send a knife signal when the knife is in the cutting position and the needle is in the penetrating position. The apparatus further includes a solenoid that is adapted to receive a pattern signal prescribing either the cutting position or the non-cutting position for the electrically-insulated knife. The solenoid is also adapted to cause the electrically-insulated knife to move between the cutting position and the non-cutting position in response to the pattern signal. The apparatus still further includes a programmable logic controller that is adapted to send the pattern signal to the solenoid, receive the knife signal from the electrically-insulated knife, compare the knife signal to the pattern signal, and determine if the electrically-insulated knife is in the position prescribed by the pattern signal.

The invention also includes a method for detecting the position of a knife on a tufting machine comprising providing an apparatus for detecting the position of a knife on a tufting machine as described immediately above. The method also includes inputting the pattern signal into the programmable logic controller, sending the pattern signal from the programmable logic controller to the solenoid, sending a knife signal from the electrically-insulated knife to the programmable logic controller, comparing the knife signal to the pattern signal, and determining if the electrically-insulated knife is in the position prescribed by the pattern signal.

In the preferred embodiments of the invention, the knife signal is produced and sent to the programmable logic controller when the electrically-insulated knife contacts the grounded needle. Also in the preferred embodiments of the invention, the programmable logic controller is adapted to activate an alarm, discontinue the operation of the tufting machine and/or store data relating to the knife signal and the pattern signal when the electrically-insulated knife is not in the position prescribed by the pattern signal a predetermined number of consecutive times.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
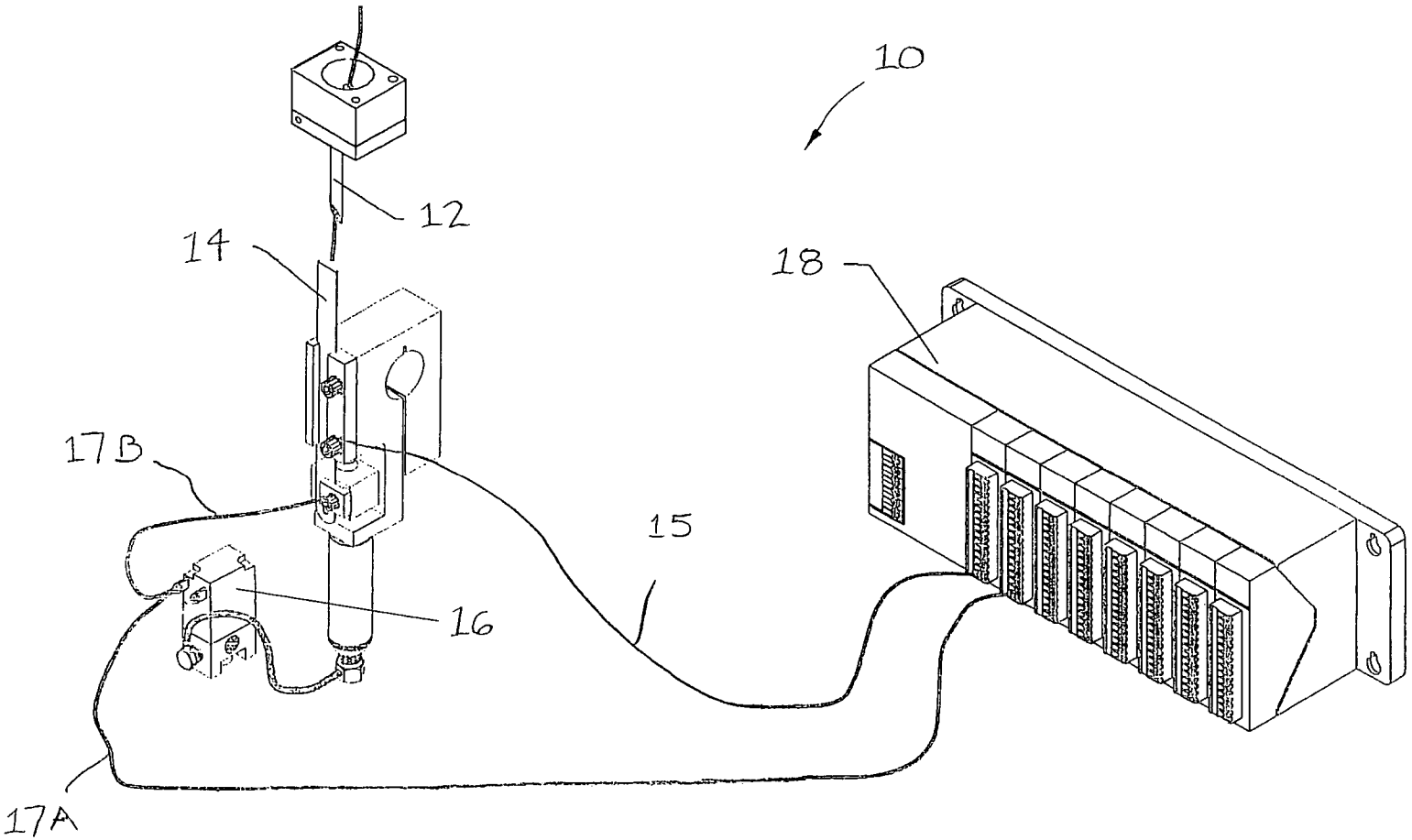
FIG. 1 is a perspective view of the preferred embodiment of the knife position detection system in accordance with the present invention.
Figure 2:
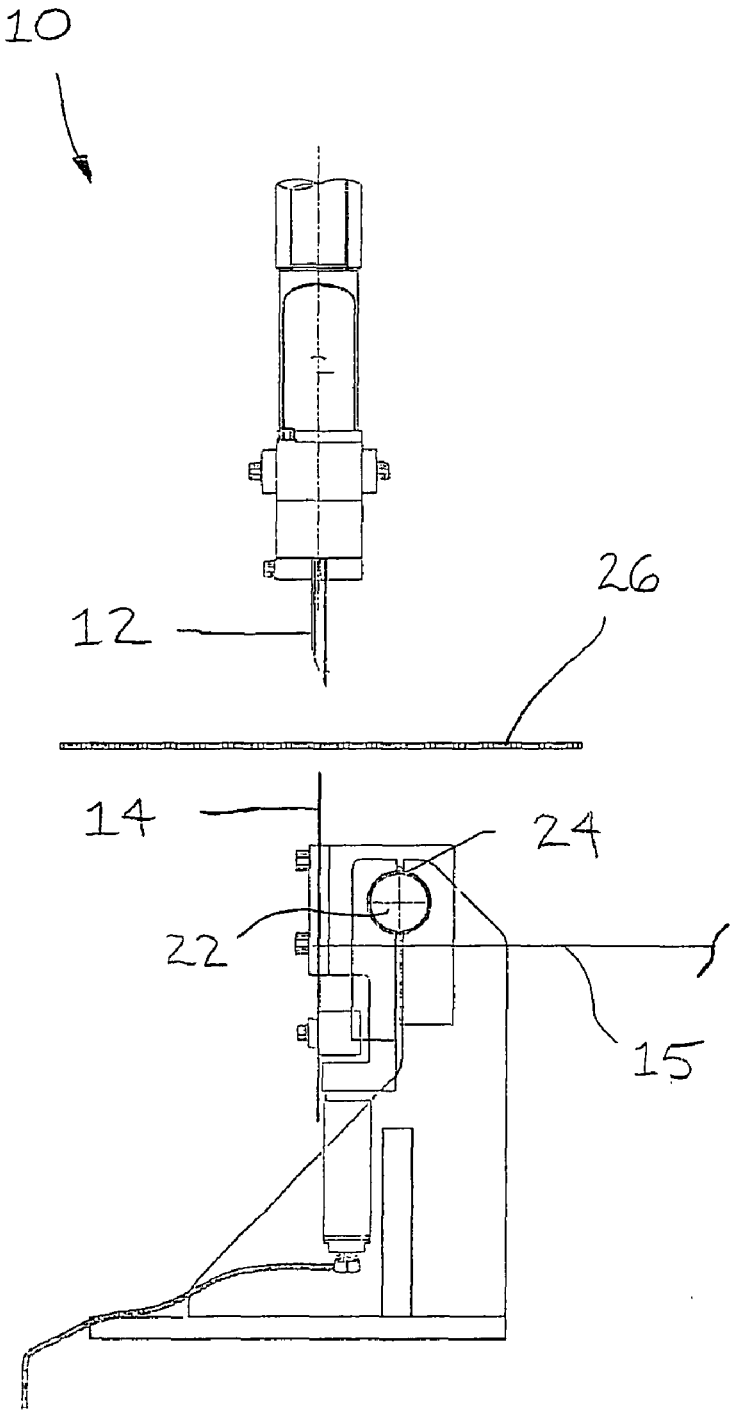
FIG. 2 is a front view of the preferred knife position detection system illustrated in FIG. 1.

Referring now to the drawings, the preferred embodiments of the knife position detection system and method for detecting the position of a knife on a tufting machine are illustrated by FIGS. 1 through 4. More particularly, FIG. 1 is a perspective view of the preferred embodiment of the knife position detection system in accordance with the present invention. As shown in FIG. 1, the preferred knife position detection system is designated generally by reference numeral 10. The preferred knife position detection system 10 is adapted to detect the position of a knife on a tufting machine, compare the actual position of the knife to the desired position of the knife, and determine when the knife is not in the desired position. The preferred knife position detection system 10 includes grounded needle 12 which is adapted to be moved between a non-penetrating position and a penetrating position. More particularly, the preferred grounded needle 12 is adapted to be moved into a position in which its distal end is farthest from the distal end of electrically-insulated knife 14, i.e., the non-penetrating position. See also FIG. 2. In the non-penetrating position, the distal end of the preferred grounded needle 12 does not contact or penetrate the backing of a tufted floor covering as shown in FIG. 2. In addition, the preferred grounded needle 12 is adapted to be moved into a position in which its distal end is nearest to the distal end of electrically-insulated knife 14, i.e., the penetrating position. In the penetrating position, the distal end of the preferred grounded needle 12 contacts and penetrates through the backing of a tufted floor covering.

While FIG. 1 illustrates only a single grounded needle 12, it is contemplated within the scope of the invention that the preferred knife position detection system may be provided with more than one needle. In addition, while FIG. 1 illustrate the preferred grounded needle 12 receiving only a single strand of yarn, it is contemplated within the scope of the invention that the grounded needle may receive more than one strand of yarn.

As shown in FIG. 1 and referenced above, the preferred knife position detection system 10 also includes electrically-insulated knife 14 which is adapted to be moved between a cutting position and a non-cutting position. More particularly, the preferred electrically-insulated knife 14 is adapted to be moved into a position in which its distal end is nearest to the distal end of grounded needle 12, i.e., the cutting position. Preferably, when electrically-insulated knife is in the cutting position, it will make contact with the preferred grounded needle 12 when the needle is moved to its penetrating position. Conversely, when the preferred electrically-insulated knife 14 is moved into a position in which its distal end is farthest from the distal end of grounded needle 12, i.e., the non-cutting position, the electrically-insulated knife will not make contact with the preferred grounded needle 12, even when the needle is moved to its penetrating position. The preferred electrically-insulated knife 14 is also adapted to send a knife signal when the electrically-insulated knife is in the cutting position and grounded needle 12 is in the penetrating position. Preferably, a knife signal is produced and sent to a programmable logic controller when the preferred electrically-insulated knife 14 contacts preferred grounded needle 12. The preferred electrically-insulated knife 14 is in electrical communication with the programmable logic controller via knife-plc wire 15.

While FIG. 1 illustrates only a single electrically-insulated knife 14, it is contemplated within the scope of the invention that the preferred knife position detection system may include more than one electrically-insulated knife. It is further contemplated that the preferred electrically-insulated knife or knives may be of any suitable configuration adapted to cut the yarn received by the grounded needle or needles. It is still further contemplated within the scope of the invention that the preferred electrically-insulated knife or knives may be connected to the programmable logic controller via any suitable means.

Still referring to FIG. 1, the preferred knife position detection system 10 also includes solenoid 16 that is adapted to receive a pattern signal prescribing either the cutting position or the non-cutting position for electrically-insulated knife 14. The preferred solenoid 16 is also adapted to cause electrically-insulated knife 14 to move between the cutting position and the non-cutting position in response to the pattern signal. Preferably, the pattern signal is received from a programmable logic controller and solenoid 16 is in electrical communication with the programmable logic controller via plc-solenoid wire 17A. The preferred solenoid 16 is in electrical communication with electrically-insulated knife 14 via solenoid-knife wire 17B.

While FIG. 1 illustrates only a single solenoid 16, it is contemplated within the scope of the invention that the preferred knife position detection system may include more than one solenoid in electrical communication with an electrically-insulated knife and/or a programmable logic controller. It is further contemplated within the scope of the invention that one solenoid may be in electrical communication with more than one electrically-insulated knife and/or more than one programmable logic controller. It is still further contemplated within the scope of the invention that the preferred solenoid or solenoids may be connected to the electrically-insulated knife or knives and the programmable logic controller or controllers via any suitable means.

Referring still to FIG. 1, the preferred knife position detection system 10 further includes programmable logic controller 18 that is adapted to send the pattern signal to solenoid 16, receive the knife signal from electrically-insulated knife 14, compare the knife signal to the pattern signal, and determine when electrically-insulated knife 14 is not in the position prescribed by the pattern signal. Preferably, programmable logic controller 18 is provided with a customized Boolean software program. The preferred programmable logic controller 18 is adapted to receive an input from an external source and determine when the knife signal is inconsistent with the pattern signal. Preferably, programmable logic controller 18 is adapted to store data relating to the knife signal and the pattern signal. While FIG. 1 illustrates a single programmable logic controller 18, it is contemplated within the scope of the invention that more than one programmable logic controller may be provided.

In the preferred embodiments of the knife position detection system, programmable logic controller 18 is adapted to activate an alarm when electrically-insulated knife 14 is not in the position prescribed by the pattern signal. In another preferred embodiment of the knife position detection system, programmable logic controller 18 is adapted to activate an alarm when electrically-insulated knife 14 is not in the position prescribed by the pattern signal a predetermined number of consecutive times. In still another preferred embodiment of the knife position detection system, programmable logic controller 18 is adapted to discontinue the operation of the tufting machine when electrically-insulated knife 14 is not in the position prescribed by the pattern signal. In yet another preferred embodiment of the knife position detection system, programmable logic controller 18 is adapted to discontinue the operation of the tufting machine when the electrically-insulated knife is not in the position prescribed by the pattern signal a predetermined number of consecutive times.

Referring now to FIG. 2, a front view of preferred knife position detection system 10 is illustrated. As shown in FIG. 2, preferred knife position detection system 10 includes grounded needle 12, electrically-insulated knife 14 and knife-plc wire 15. More particularly, the preferred electrically-insulated knife 14 is electrically insulated from knife shaft 22 of the tufting machine by bushing 24. As can be appreciated from FIG. 2, preferred grounded needle 12 is adapted to move between a non-penetrating position (as shown) in which the needle is not in contact with backing 26 of tufted floor covering and a penetrating position (not shown) in which the distal end of the needle penetrates the backing. As can also be appreciated from FIG. 2, when the electrically-insulated knife is moved into a position in which its distal end is nearest to the distal end of grounded needle 12, i.e., the cutting position, the electrically-insulated knife will make contact with the needle when the needle is moved to its penetrating position. Conversely, when the electrically-insulated knife is moved into a position in which its distal end is farthest from the distal end of grounded needle 14, i.e., the non-cutting position, the electrically-insulated knife will not make contact with the needle when the needle is moved to its penetrating position. The preferred grounded needle 12 is adapted to be moved between the penetrating position and the non-penetrating position by a rotating drive shaft or any other suitable means.

Figure 3:
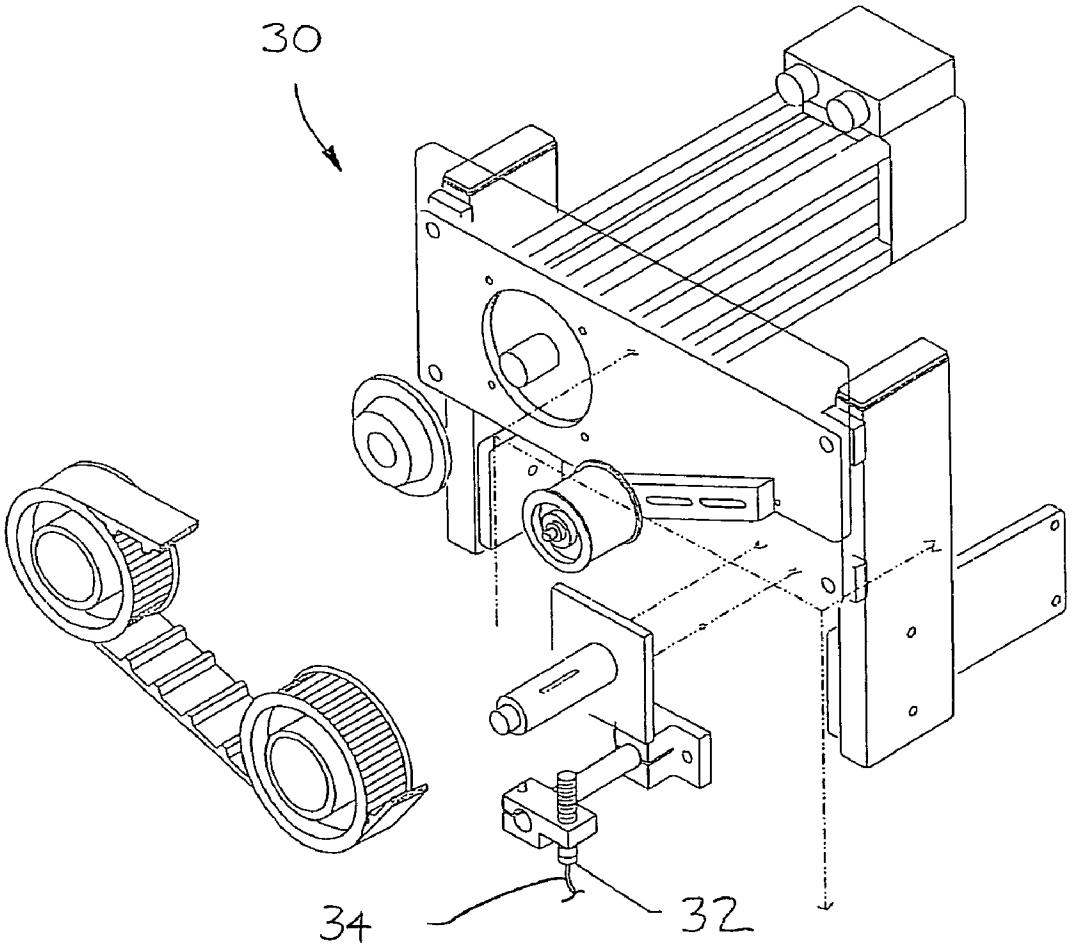
FIG. 3 is a perspective view of the preferred main drive shaft assembly including a proximity switch in accordance with the preferred embodiments of the present invention.

Referring now to FIG. 3, a perspective view of the preferred main drive shaft assembly 30 including a switch such as proximity switch 32 is illustrated. The preferred proximity switch 32 is adapted to monitor the position of the main drive shaft and send an instruction to programmable logic controller 18. More particularly, the preferred proximity switch 32 is adapted to instruct programmable logic controller 18 to compare the knife signal to the pattern signal. Preferably, proximity switch 32 sends such an instruction to programmable logic controller 18 when grounded needle 12 is in the penetrating position. The preferred proximity switch 32 sends such an instruction via switch-plc wire 34, but it is contemplated within the scope of the invention that the switch may send such an instruction via any suitable means.

Figure 4:
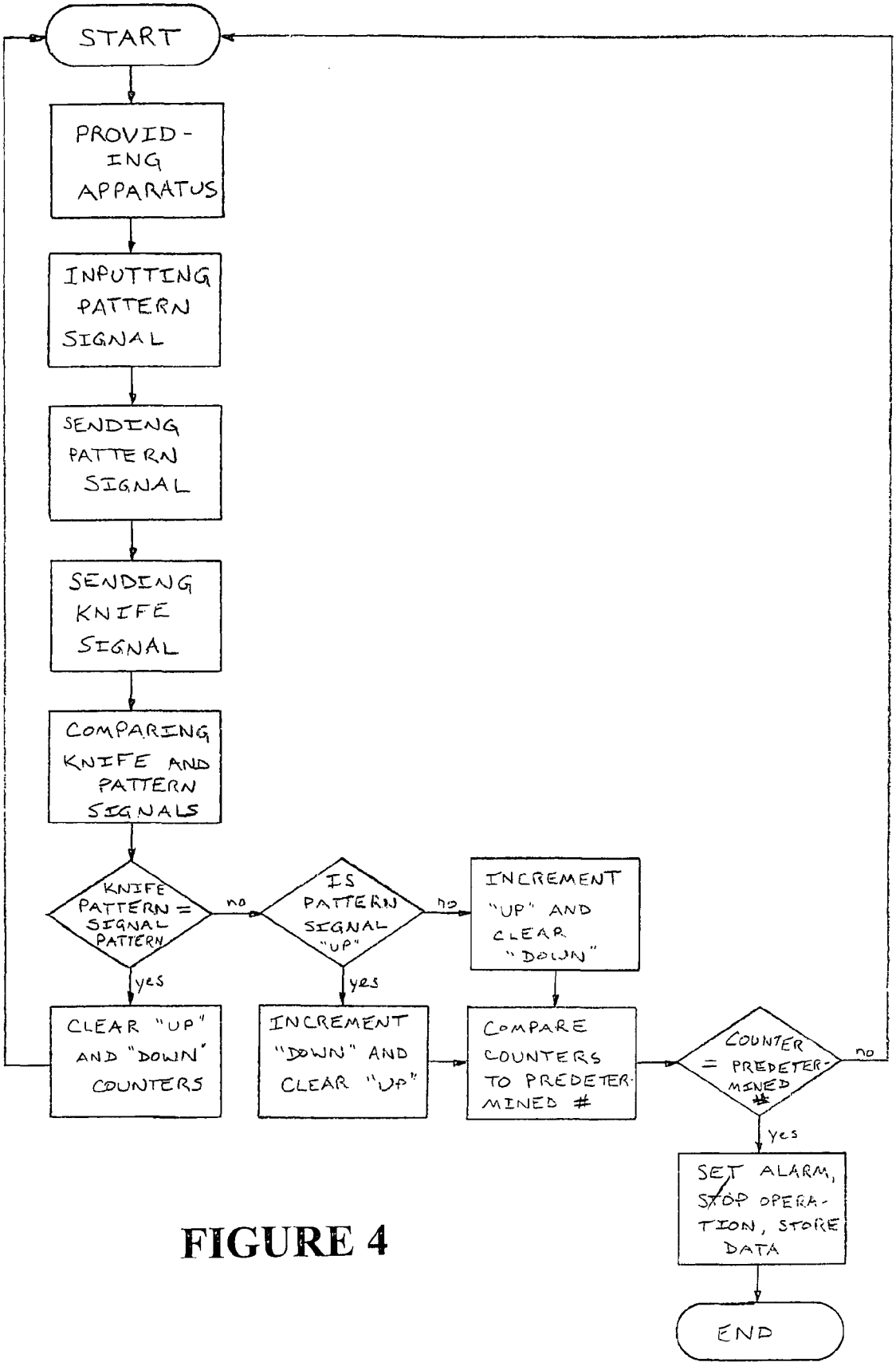
FIG. 4 is a flow chart illustrating the preferred method for detecting the position of a knife on a tufting machine in accordance with the present invention.

Referring now to FIG. 4, a flow chart of the preferred method for detecting the position of a knife on a tufting machine is illustrated. According to the preferred method for detecting the position of a knife on a tufting machine, an apparatus for detecting the position of a knife on a tufting machine is provided. As described above, the preferred apparatus comprises a grounded needle and an electrically-insulated knife that is adapted to be moved between a cutting position and a non-cutting position. The preferred electrically-insulated knife is also adapted to send a knife signal when the knife is in the cutting position. The preferred apparatus also includes a solenoid that is adapted to receive a pattern signal prescribing either the cutting position or the non-cutting position for the electrically-insulated knife. The preferred solenoid is also adapted to cause the electrically-insulated knife to move between the cutting position and the non-cutting position. The preferred apparatus further includes a programmable logic controller that is adapted to send the pattern signal to the solenoid, receive the knife signal from the electrically-insulated knife, compare the knife signal to the pattern signal, and determine when the electrically-insulated knife is not in the position prescribed by the pattern signal.

Still referring to FIG. 4, the preferred method for detecting the position of a knife on a tufting machine also includes inputting the pattern signal into the programmable logic controller, sending the pattern signal from the programmable logic controller to the solenoid, sending a knife signal from the electrically-insulated knife to the programmable logic controller, comparing the knife signal to the pattern signal, and determining when the electrically-insulated knife is not in the position prescribed by the pattern signal. Preferably, the method includes moving the knife in response to the pattern signal. In the preferred embodiments of the method of the invention, the knife signal is produced and sent to the programmable logic controller when the electrically-insulated knife contacts the grounded needle. The preferred method of the invention also includes determining when the knife signal is inconsistent with the pattern signal. As shown in FIG. 4, if the knife signal is consistent with the pattern signal, i.e., the actual position of the knife is the same as the desired position of the knife, then the method returns to the start.

If, on the other hand, the actual position of the knife is not the same as the desired position of the knife, i.e., the knife signal is not consistent with the pattern signal, then the preferred method for detecting the position of a knife on a tufting machine determines whether the knife is experiencing a cutting position problem (i.e., the knife is sticking in the "up" position when it should be in the "down" position) or a non-cutting position problem (i.e., the knife is sticking in the "down" position when it should be in the "up" position). More particularly, the preferred method determines whether the knife is in the cutting position when the pattern signal prescribes the non-cutting position (a cutting position problem) or whether the knife is in the non-cutting position when the pattern signal prescribes the cutting position (a non-cutting position problem).

If the preferred method determines that there is a cutting position problem, a cutting position problem counter is increased by one and a non-cutting position problem counter is cleared. If the preferred method determines that there is a non-cutting position problem, the non-cutting position problem counter is increased by one and the cutting position problem counter is cleared. It is also contemplated within the scope of the invention that if the preferred method determines that there is a cutting position problem, then the cutting position problem counter is increased by one but the non-cutting position counter is not cleared. Similarly, it is also contemplated within the scope of the invention that if the preferred method determines that there is a non-cutting position problem, the non-cutting position problem counter is increased by one but the cutting position problem counter is not cleared. The counter may be any suitable device, mechanism, assembly or combination thereof adapted to maintain an accurate count of the number of incidences in which the knife signal is not consistent with the pattern signal.

Next, the preferred method compares the cutting position problem counter and the non-cutting position problem counter with the predetermined number of consecutive times that has been set to activate the alarm, discontinue the operation of the tufting machine and/or store the data relating to the knife signal and the pattern signal. If the preferred method determines that either of the position problem counter equals the predetermined number of consecutive times that has been set to activate the alarm, discontinue the operation of the tufting machine and/or store the data relating to the knife signal and the pattern signal, then the alarm is activated, the operation of the tufting machine is discontinued and/or the data relating to the knife signal and the pattern signal is stored. If, on the other hand, neither of the position problem counters equals the predetermined number of consecutive times that has been set to activate the alarm, discontinue the operation of the tufting machine and/or store the data relating to the knife signal and the pattern signal, then the method returns to the start.

While FIG. 4 contemplates that the alarm is activated (or the operation of the tufting machine is discontinued and/or the data relating to the knife signal and the pattern signal) only after the electrically-insulated knife is not in the position prescribed by the pattern signal a predetermined number of consecutive times, it is contemplated within the scope of the invention that the alarm may be activated (or the operation of the tufting machine is discontinued and/or the data relating to the knife signal and the pattern signal) when the electrically-insulated knife is not in the position prescribed by the pattern signal only one time. Further, the preferred method of the invention includes interrogating or polling the programmable logic controller for the stored data relating to the knife signal and the pattern signal.

In operation, several advantages of the preferred embodiments of the invention are achieved. For example, the preferred embodiments of the invention provide an apparatus that detects the position of a knife on a tufting machine, compares the actual position of the knife to the desired position of the knife, and determines when the knife is not in the desired position. The preferred embodiments of the invention also provide a method for detecting the position of a knife on a tufting machine, comparing the actual position of the knife to the desired position of the knife, and determining when the knife is not in the desired position. The preferred embodiments of the invention further provide an apparatus and method that reduces the number of manufacturing defects in and the amount of repair required for a tufted floor covering.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An apparatus for detecting the position of a knife on a tufting machine, said apparatus comprising:

(a) a grounded needle, said grounded needle being adapted to be moved between a penetrating position and a non-penetrating position;

(b) an electrically-insulated knife, said electrically-insulated knife being adapted to be moved between a cutting position and a non-cutting position and being adapted to send a knife signal when the knife is in the cutting position and the needle is in the penetrating position;

(c) a solenoid, said solenoid being adapted to receive a pattern signal prescribing either the cutting position or the non-cutting position for the electrically-insulated knife and being adapted to cause the electrically-insulated knife to move between the cutting position and the non-cutting position in response to the pattern signal and;

(d) a programmable logic controller, said programmable logic controller being adapted to:

(1) send the pattern signal to the solenoid;

(2) receive the knife signal from the electrically-insulated knife;

(3) compare the knife signal to the pattern signal; and (4) determine if the electrically-insulated knife is in the position prescribed by the pattern signal.

2. The apparatus of claim 1 wherein the knife signal is produced and sent to the programmable logic controller when the electrically-insulated knife contacts the grounded needle.

3. The apparatus of claim 1 wherein the electrically-insulated knife is in electrical communication with the programmable logic controller.

4. The apparatus of claim 1 further comprising a switch, said switch being adapted to send an instruction to the programmable logic controller.

5. The apparatus of claim 1 wherein the solenoid is in electrical communication with the programmable logic controller.

6. The apparatus of claim 1 wherein the programmable logic controller is adapted to receive an input from an external source.

7. The apparatus of claim 1 wherein the programmable logic controller is adapted to determine when the knife signal is inconsistent with the pattern signal.

8. The apparatus of claim 1 wherein the programmable logic controller is adapted to activate an alarm when the electrically-insulated knife is not in the position prescribed by the pattern signal.

9. The apparatus of claim 1 wherein the programmable logic controller is adapted to activate an alarm when the electrically-insulated knife is not in the position prescribed by the pattern signal a predetermined number of consecutive times.

10. The apparatus of claim 1 wherein the programmable logic controller is adapted to discontinue the operation of the tufting machine when the electrically-insulated knife is not in the position prescribed by the pattern signal.

11. The apparatus of claim 1 wherein the programmable logic controller is adapted to discontinue the operation of the tufting machine when the electrically-insulated knife is not in the position prescribed by the pattern signal a predetermined number of consecutive times.

12. The apparatus of claim 1 wherein the programmable logic controller is adapted to store data relating to the knife signal and the pattern signal.

13. A method for detecting the position of a knife on a tufting machine, said method comprising:

(a) providing an apparatus for detecting the position of a knife on a tufting machine, said apparatus comprising:

(1) a grounded needle, said grounded needle being adapted to be moved between a penetrating position and a non-penetrating position;

(2) an electrically-insulated knife, said electrically-insulated knife being adapted to be moved between a cutting position and a non-cutting position and being adapted to send a knife signal when the knife is in the cutting position and the needle is in the penetrating position;

(3) a solenoid, said solenoid being adapted to receive a pattern signal prescribing either the cutting position or the non-cutting position for the electrically-insulated knife and being adapted to cause the electrically-insulated knife to move between the cutting position and the non-cutting position in response to the pattern signal and;

(4) a programmable logic controller, said programmable logic controller being adapted to:

(i) send the pattern signal to the solenoid;

(ii) receive the knife signal from the electrically-insulated knife;

(iii) compare the knife signal to the pattern signal; and (iv) determine if the electrically-insulated knife is in the position prescribed by the pattern signal;

(b) inputting the pattern signal into the programmable logic controller;

(c) sending the pattern signal from the programmable logic controller to the solenoid;

(d) sending a knife signal from the electrically-insulated knife to the programmable logic controller;

(e) comparing the knife signal to the pattern signal;

(f) determining if the electrically-insulated knife is in the position prescribed by the pattern signal.

14. The method of claim 13 further comprising moving the knife in response to the pattern signal.

15. The method of claim 13 further comprising producing and sending the knife signal to the programmable logic controller when the electrically-insulated knife contacts the grounded needle.

16. The method of claim 13 further comprising determining when the knife signal is inconsistent with the pattern signal.

17. The method of claim 13 further comprising activating an alarm when the electrically-insulated knife is not in the position prescribed by the pattern signal.

18. The method of claim 13 further comprising activating an alarm when the electrically-insulated knife is not in the position prescribed by the pattern signal a predetermined number of consecutive times.

19. The method of claim 13 further comprising discontinuing the operation of the tufting machine when the electrically-insulated knife is not in the position prescribed by the pattern signal.

20. The method of claim 13 further comprising discontinuing the operation of the tufting machine when the electrically-insulated knife is not in the position prescribed by the pattern signal a predetermined number of consecutive times.

21. The method of claim 13 further comprising storing data relating to the knife signal and the pattern signal.

22. The method of claim 13 further comprising interrogating the programmable logic controller.

* * * * *